US011457710B1

(12) United States Patent
Joseph

(10) Patent No.: US 11,457,710 B1
(45) Date of Patent: Oct. 4, 2022

(54) SYSTEM TO WHEEL MULTIPLE PIECES OF LUGGAGE SIMULTANEOUSLY

(71) Applicant: Robert Joseph, Jersey City, NJ (US)

(72) Inventor: Robert Joseph, Jersey City, NJ (US)

( * ) Notice: Subject to any disclaimer, the term of this patent is extended or adjusted under 35 U.S.C. 154(b) by 250 days.

(21) Appl. No.: 16/812,729

(22) Filed: Mar. 9, 2020

(51) Int. Cl.
*A45C 13/30* (2006.01)
*A45C 5/03* (2006.01)
*A45C 5/14* (2006.01)

(52) U.S. Cl.
CPC ..... *A45C 13/30* (2013.01); *A45C 5/03* (2013.01); *A45C 5/14* (2013.01); *A45C 2013/306* (2013.01)

(58) Field of Classification Search
CPC .. A45C 5/03; A45C 13/30; A45C 5/14; A45C 2013/306
USPC ..... 190/18, 108
See application file for complete search history.

(56) References Cited

U.S. PATENT DOCUMENTS 1,483,253 A * 2/1924 Tabler ..... B60D 1/187 280/480
5,713,439 A 2/1998 Zionts et al.
D664,735 S * 7/2012 Manning ..... D34/27
9,585,448 B2 3/2017 Herold
2006/0032687 A1* 2/2006 Park ..... H02J 7/32 180/65.1
2007/0164067 A1* 7/2007 Wright ..... A45F 5/00 224/401
2008/0308369 A1* 12/2008 Louis ..... A45C 5/14 190/108
2013/0271063 A1* 10/2013 Wilson ..... H02J 7/1415 320/103
2016/0257479 A1* 9/2016 Seiders ..... B65D 81/3897
2017/0172271 A1* 6/2017 Herold ..... A45C 13/262
2017/0354218 A1* 12/2017 Kim ..... A45C 5/14

FOREIGN PATENT DOCUMENTS

CN 104586004 A * 5/2015
CN 108514198 A * 9/2018 ..... A45C 5/146

* cited by examiner

*Primary Examiner* — John K Fristoe, Jr.
*Assistant Examiner* — Jessica Kavini Tamil
(74) *Attorney, Agent, or Firm* — Sanchelima & Associates, P.A.; Christian Sanchelima; Jesus Sanchelima

(57) ABSTRACT

A system to wheel multiple pieces of luggage simultaneously is disclosed herein. The luggage coupling system Includes connecting straps along the bodies of the luggage. Furthermore the, coupling devices link the wheels of the luggage together to form one system. Additionally, the system includes a track assembly that is mounted on to the back end of each luggage. The track assembly allows for a user to easily transport the luggage system up and down a staircase. The system further includes a battery pack to allow a user to charge their mobile devices as they are transporting their luggage.

11 Claims, 4 Drawing Sheets

SYSTEM TO WHEEL MULTIPLE PIECES OF LUGGAGE SIMULTANEOUSLY

BACKGROUND OF THE INVENTION

1. Field of the Invention

The present invention relates to a system to wheel multiple pieces of luggage simultaneously and, more particularly, to a system to wheel multiple pieces of luggage that allows a user to effectively and efficiently transport multiple luggage, bags, and the like.

2. Description of the Related Art

Several designs for a system to wheel multiple pieces of luggage simultaneously have been designed in the past. None of them, however, include a luggage coupling device comprising connecting straps along the bodies of the luggage. Furthermore the, coupling devices link the wheels of the luggage together to form one system. Additionally, the system includes a track assembly that is mounted on to the back end of each luggage. The track assembly allows for a user to easily transport the luggage system up and down a staircase. The system further includes a battery pack to allow a user to charge their mobile devices as they are transporting their luggage. It is known that individuals often travel with multiple bags of luggage in order to carry all the appropriate belongings needed when traveling. It is also known that individuals often have a need to simultaneously carry all the luggage to be able to quickly maneuver around locations such as airports. Therefore, there is a need for an efficient and effortless system to wheel multiple pieces of luggage simultaneously.

Applicant believes that a related reference corresponds to U.S. Pat. No. 9,585,448 for a self-stabilized rollable luggage assembly and corresponding assembly method. Applicant believes that another related reference corresponds to U.S. Pat. No. 5,713,439 issued for a dual point auxiliary luggage attachment system. However, these references differ from the present invention because the references fail to address the issue of being able to efficiently transport more than two luggage bags as well as additional bags without wheels simultaneously in one system. The present invention addresses this issue be providing a strap assembly including straps and coupling devices configure to be attached to the wheels of multiple luggage wheels. The present invention further includes a tension buckle to allow a user to secure bags without wheels on top the system of luggage. Additionally, the present invention includes a track assembly that aids a user in transporting the luggage system along a staircase.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a system to wheel multiple pieces of luggage simultaneously that allows a user to effortlessly and efficiently transport multiple pieces of luggage together.

It is another object of this invention to provide a system to wheel multiple pieces of luggage simultaneously that provides a tension buckle to allow a user to secure multiple bags on top of the luggage to allow a user to efficiently transport bags absent of wheels.

It is still another object of the present invention to provide a system to wheel multiple pieces of luggage simultaneously that includes a strap assembly to provide a user with an efficient means of attaching several pieces of luggage together.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
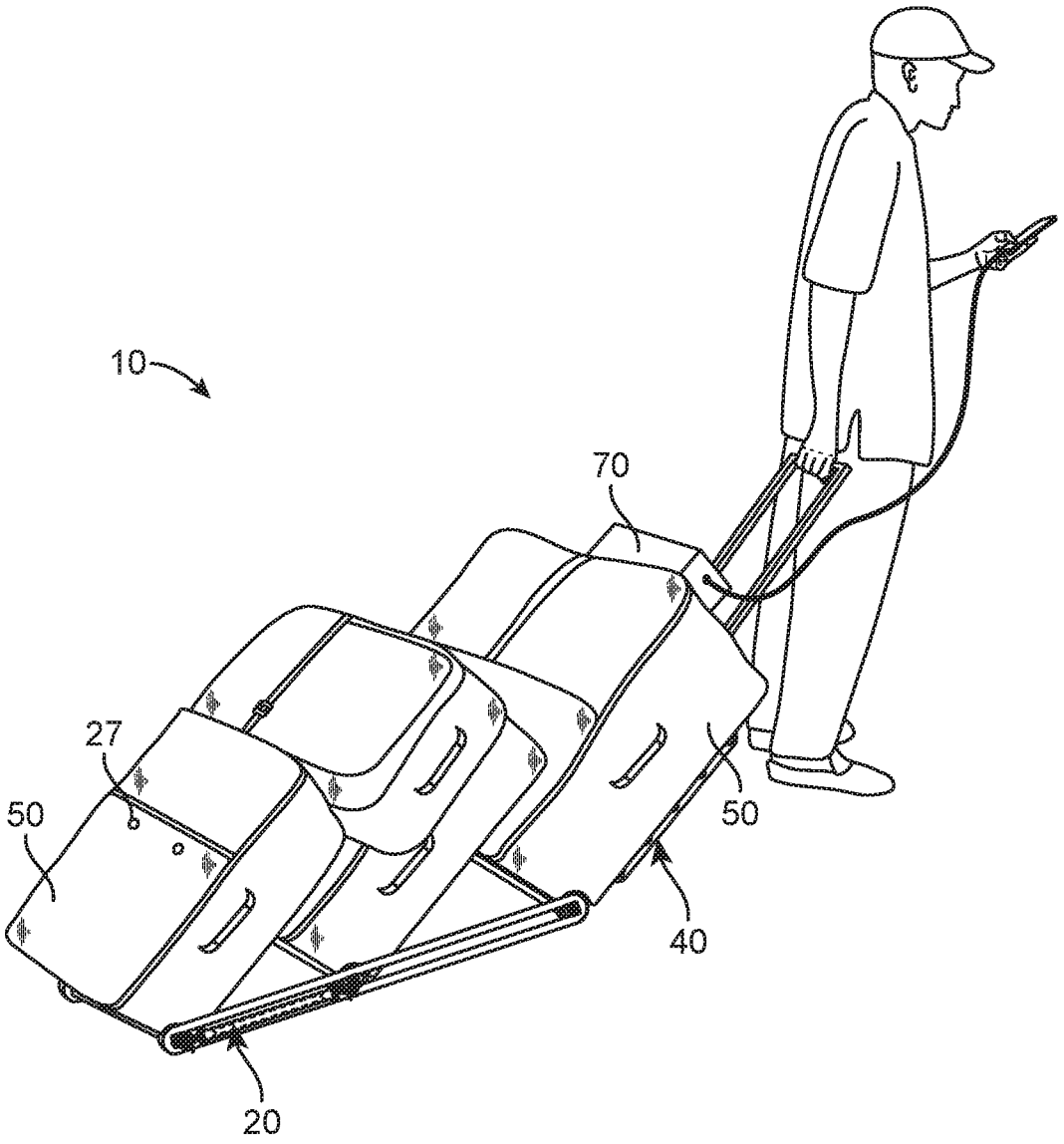
FIG. 1 represents an isometric view of a system to wheel multiple pieces of luggage simultaneously 10 in an operational setting in accordance to an embodiment of the present invention.
Figure 2:
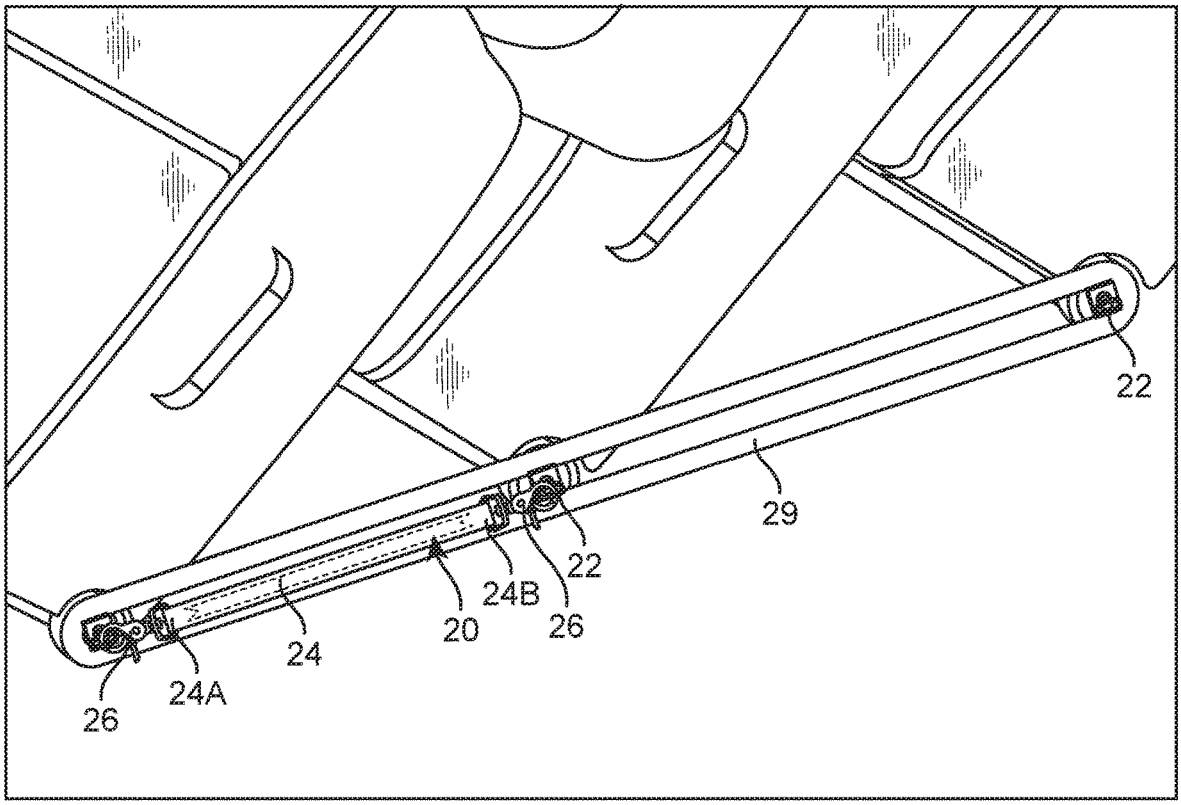
FIG. 2 shows an enlarged view of strap assembly 20 depicting strap locks 22 and connecting straps 24 in accordance with an embodiment of the present invention.
Figure 3:
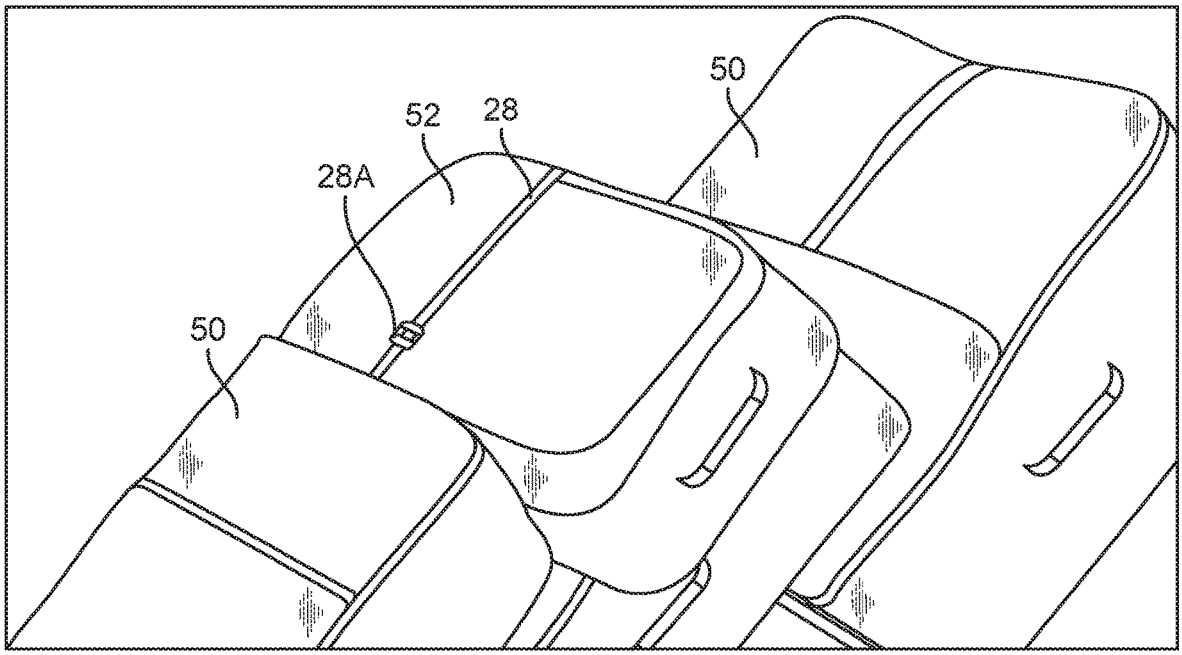
FIG. 3 illustrates an enlarged view of carry-on luggage 52 depicting coupling strap 28 in accordance with an embodiment of the present invention.
Figure 4:
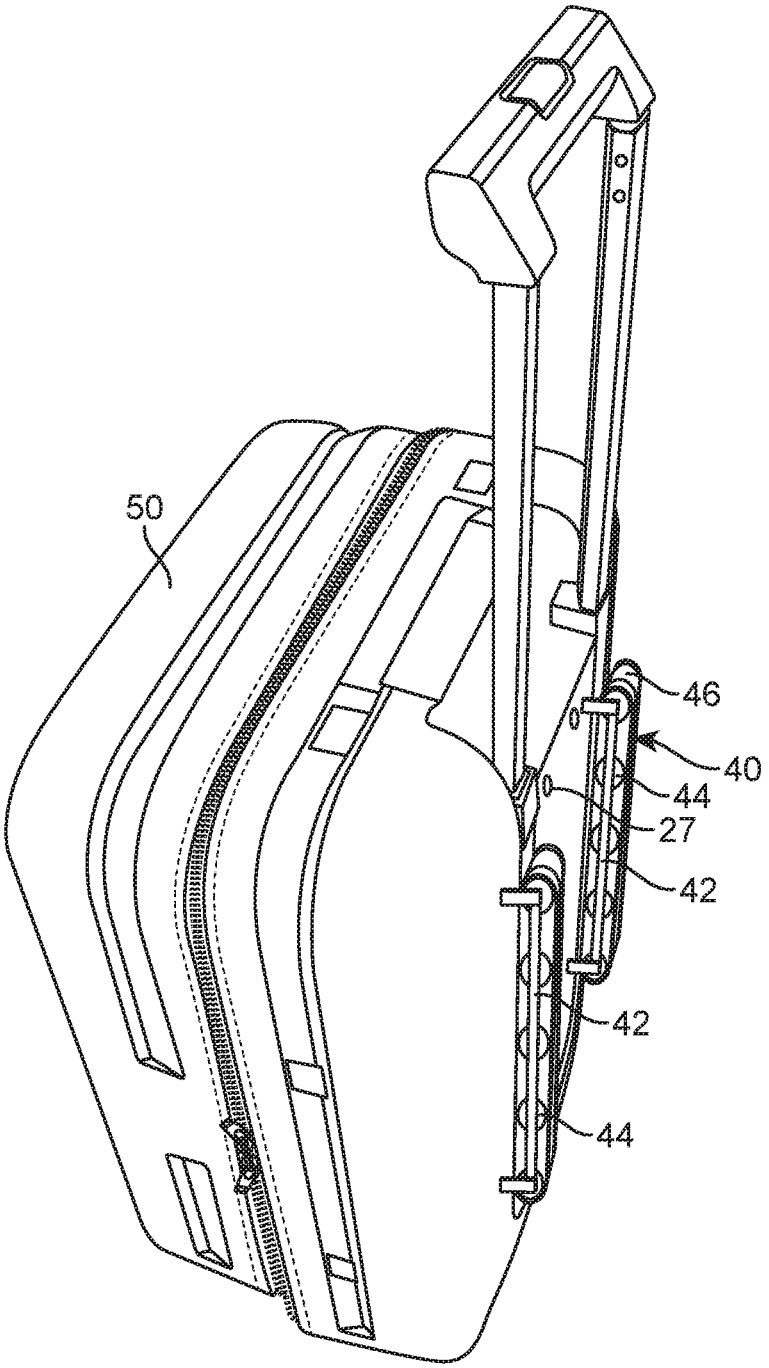
FIG. 4 is a representation of a rear isometric view of luggage pieces 50 depicting track assembly 40 mounted thereon.

Referring now to the drawings, where the present invention is generally referred to with numeral 10, it can be observed a luggage coupling system 10 including a strap assembly 20 and a track assembly 40.

Strap assembly 20 includes strap locks 22 mounted on each wheel of luggage pieces 50. In one embodiment, strap locks 22 is mounted onto an outer surface of the wheel. Additionally, strap locks 22 may be a hook like member that is made of a metal material. The strap locks 22 may include a rectangular base with a circular anchoring member attached thereon. In one embodiment, strap locks 22 are provided as an integral connection to the wheels of the luggage pieces 50. In another embodiment, strap locks 22 are provided as a removable attachment using known means in the art such as fasteners, adhesives and the like. This allows strap locks 22 to be removed and attached to various existing luggage pieces. Other embodiments may feature strap locks 22 having different configurations of anchoring members. Base assembly 20 further include connecting straps 24 which include a first end 24A and a second end 24B. Connecting straps 24 are then coupled to strap locks 22 to then create a secure connection system of luggage pieces 50. In one embodiment, connecting straps 24 are made of a durable leather material that may withstand a significant amount of pulling force. Additionally, connecting straps 24 may also be made of a stretchable cloth material to withstand a significant amount of pulling force. In one embodiment, connecting straps 24 are also rectangular in shape.

Furthermore, first end 24A and second end 24B each have a snap lock 26 mounted thereon. In one embodiment, snap lock 26 may be made of a durable metal material to then latch onto snap locks 22. In one embodiment, snap locks 26 are provided as an integral part of connecting straps 24. In another embodiment, snap locks 26 are provided as a removable component of connecting straps 24. This allows a user to then mount snap locks 26 onto connecting straps 24 of their desired length. As a result, a user may build the best connecting system that is suitable for their luggage. Luggage pieces 50 may further include a carry-on luggage 52 mounted onto a top end of the luggage system. In one embodiment, carry-on luggage 52 is a bag absent of wheels. Carry-on luggage 52 is then secured to the luggage pieces 50 through coupling strap 28 including a tension buckle 28A. In one embodiment, coupling strap 28 is made of a cloth material and tension buckle 28A is made of a plastic material. Additionally, tension buckle 28A as known in the art allows a user to adjust the length and tension of coupling strap 28 in order to properly secure carry-on luggage 52 onto the luggage pieces 50. Base assembly 20 further includes a connector 29 used to couple a row of wheels from luggage pieces 50. In one embodiment, connector 29 is an elongated stretchable strap having an oval shape. Connector 29 is then wrapped around snap locks 22 to create a secure attachment. In on embodiment, connector 29 is mounted to each set of wheels for luggage pieces 50. The combination of the strap locks 22, the connecting straps 24, and connectors 29 allows the luggage pieces to work as one system to create a luggage train. As a result, a user may then transport multiple pieces of luggage through means of one system. This alleviates stress for a user and makes traveling a more comfortable experience.

Track assembly 40 includes a track 42 that is mounted to a back end of each piece of luggage pieces 50. In one embodiment, two of tracks 42 are mounted to the back end of luggage pieces. Additionally, tracks 42 may be mounted in a vertical configuration along the back end of luggage pieces 50. In one embodiment, tracks 42 are located entirely within the back end of luggage piece 50. In another embodiment, tracks 42 extend onto an outer area of the back end of luggage pieces 50. Other embodiments may feature track 42 positioned in other configurations along luggage pieces 50. In one embodiment, only one track 42 may be provided. Track 42 includes pulleys 44 mounted thereon in a horizontal configuration. In one embodiment, pulleys 44 are made of a metal material to withstand a significant amount of impact and have a durable lifespan. Additionally, pullets 44 may be a solid cylindrical member that is mounted onto track 42. Track assembly 40 further includes a conveyer belt 46 that is wrapped around an outer surface of pulleys 46. In one embodiment conveyer belt 46 is made of a silicon material to improve traction on an outer surface. In one embodiment, conveyer belt 46 is a slider bed conveyer belt. In another embodiment, conveyer belt 46 is a horizontal slat conveyer belt. In the present embodiment, conveyer belt 46 aids a user in transporting luggage pieces 50 up and down a set of stairs. The conveyer belt 46 will then come into contact with the outer edge of the stairs to then aid a user in pulling the luggage up and down the stairs. In one embodiment, conveyer belt 46 is powered by an internal motor within the luggage pieces 50 to then further aid a user in maneuvering the luggage pieces up and down the stairs. The luggage coupling system 10 further includes a battery bank 70 that may be used to charge a user's mobile device.

In one implementation of the present invention, button locks 27 may be added to the front end and back end of a luggage. These button locks 27 may then be coupled to each other in order to create an effective connection between multiple luggage. The button locks 27 from the back of a luggage receive the buttons locks located on the front of another luggage. As a result, a row of luggage is joined to form a luggage train. These button locks 27 may be used in conjunction with strap assembly 20 or it may be used independently from strap assembly 20. Although button locks 27 provide an effective coupling method, other forms of suitable locks may also be used.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A luggage coupling system, comprising:

a. a strap assembly including hook members mounted onto an outer rotating portion of wheels of at least two luggage pieces, connecting straps having snap locks located at each end, wherein the snap locks of said connecting straps are coupled to said hook members that are mounted onto said rotating portion of the wheels of said at least two luggage pieces to create a luggage train, wherein said connecting straps connect to the rotating portion of wheels by means of the hook members; and b. a track assembly including at least one track mounted onto a back end of said at least two luggage pieces, wherein said at least one track includes pulleys mounted adjacently thereon, a conveyer belt wrapped around said pulleys.

2. The luggage coupling system of claim 1 wherein said hook members are circular in shape.

3. The luggage coupling system of claim 1 wherein said connecting straps are rectangular in shape.

4. The luggage coupling system of claim 1 wherein said snap locks are made of a metallic material.

5. The luggage coupling system of claim 1 wherein said at least two luggage pieces includes a battery bank to charge a user's mobile device.

6. The luggage coupling system of claim 1 wherein said strap assembly includes a coupling strap to secure a carry-on luggage onto a top end of said at least two luggage pieces.

7. The luggage coupling system of claim 1 wherein said at least one track is mounted in a vertical configuration along said back end of said at least two luggage pieces.

8. The luggage coupling system of claim 1 wherein said conveyer belt is a slider bed conveyer belt.

9. The luggage coupling system of claim 1 wherein said conveyer belt is a horizontal slat conveyer belt.

10. The luggage coupling system of claim 1 wherein said strap assembly further includes a connector coupled to a base of each of said hook members that are mounted onto said outer rotating portion, wherein each base of each hook member has a rectangular shape, wherein said connector rotates on said outer rotating portion of the wheels.

11. A luggage coupling system, comprising:

a. three luggage pieces each having wheels, said wheels having an outer rotating portion;

b. a carry-on luggage mounted onto a top end of one of said three luggage pieces;

c. a battery bank located on one of said three luggage pieces;

d. a strap assembly including strap locks mounted on said outer rotating portion of said wheels, wherein said strap locks are hook members perpendicularly mounted onto said outer rotating portion, said hook members being circular in shape, said strap assembly further including connecting straps having a rectangular shape and each having a first end and a second end, wherein said first end and said second end include snap locks, wherein said snap locks are made of a metallic material, wherein said snap locks are snapped onto said hook members to create a secure attachment, wherein said connecting straps connect to the rotating portion of wheels by means of the hook members, wherein said strap assembly includes a coupling strap having a tension buckle, wherein said coupling strap is mounted onto said carry-on luggage in a vertical configuration to secure said carry-on luggage to said three luggage pieces; and e. a track assembly including two tracks mounted onto a back end of each of said three luggage pieces, wherein said two tracks are mounted in a vertical position along said back end, wherein each of said two tracks include six pulleys located therein, said six pulleys have a cylindrical shape, wherein said six pulleys includes a conveyer belt wrapped around each of said six pulleys, wherein said conveyer belt is a horizontal slat conveyer belt.

* * * * *